US005393172A

United States Patent [19]

Akesaka

[11] Patent Number: 5,393,172

[45] Date of Patent: Feb. 28, 1995

[54] SHIELD TUNNELING MACHINE

[75] Inventor: Toshio Akesaka, Yokohama, Japan

[73] Assignee: Kabushiki Kaisha Iseki Kaihatsu Koki, Tokyo, Japan

[21] Appl. No.: 70,624

[22] Filed: Jun. 2, 1993

[30] Foreign Application Priority Data

Jun. 11, 1992 [JP] Japan ..... 4-176037

[51] Int. Cl.[6] ..... E21D 9/08

[52] U.S. Cl. ..... 405/141; 299/56; 299/64; 405/138

[58] Field of Search ..... 405/138, 141, 144; 299/31, 33, 55, 56, 64

[56] References Cited

U.S. PATENT DOCUMENTS 5,032,039 7/1991 Hagimoto et al. ..... 405/141
5,102,201 4/1992 Akesaka et al. ..... 405/138 X
5,127,711 7/1992 Cass ..... 299/56

FOREIGN PATENT DOCUMENTS

0392583B1 7/1993 European Pat. Off. .

*Primary Examiner*—David H. Corbin
*Attorney, Agent, or Firm*—Townsend & Banta

[57] ABSTRACT

A shield tunneling machine comprises a shield body having a soil chamber, an inside chamber and a partition wall. The soil chamber has a conical peripheral surface converging gradually rearward. A crankshaft having an eccentric portion is rotatably supported by the partition wall at the center of the partition wall corresponding to the axis of the shield body. A cutter disc with roller bits is secured to a front end of the crankshaft, and a conical rotor is rotatably mounted on the eccentric portion of the crankshaft behind the cutter disc. Since the cutter disc is rotated at an increased rotary velocity by five to ten times as many as that of a cutter disc in a conventional shield tunneling machine, crushing of gravel can be efficiently carried out by the cutter disc with roller bits in cooperation with the conical rotor mounted on the crankshaft.

4 Claims, 4 Drawing Sheets

SHIELD TUNNELING MACHINE

BACKGROUND OF THE INVENTION

1. Field of the Invention

The present invention relates to a shield tunneling machine which is adapted to efficiently excavate the ground composed of all types of soil, such as a rock mass layer, a boulder layer, or a clay or cohesive soil layer.

2. Description of the Prior Art

A semi-shield method is used for laying conduits, in which the conduits are laid under the ground by interconnected pipes, such as Hume pipes, after excavating the ground with an excavator or a shield tunneling machine. However, conventional shield tunneling machines adapted for ground excavation do not have gravel crushing means, and which a cutter head or a front disc cutter thereof, is provided with small hole so that the size of the gravel taken into the shield body is limited within a given amount by the small holes. For this reason, the gravel must be broken down into sail sizes by roller bits mounted on the front disc cutter so that the propulsion of the shield tunneling machine cannot be effective. Further, when excavating cohesive soil, accidents frequently occur when the small holes become clogged making excavation impossible.

The present inventor has invented a shield propelling machine which is disclosed in Provisional Patent Publication Application No. 242295 of 1985. The disclosed shield tunneling machine comprises a shield body, a conical inner surface formed on the front of the shield tunneling machine, wherein the conical inner surface defines a conical chamber having a bore which gradually converges rearward, a partition wall formed on the shield machine behind the conical inner surface, a shaft an end of which is rotatably supported by a bearing provided on the partition wall and the other end of which is rotatably supported by a bearing provided on the front portion of the shield body, a tapered consolidation head, and a conical rotor mounted on the shaft so as to be eccentrically rotatable about the center axis of the shield body. A boss is fixed to the front end of the shaft and spokes extending radially from the boss are provided on the shaft. Bits and chips are disposed on the spokes.

The above-mentioned shield propelling machine is designed to be used for excavating the ground composed of a cohesive soil layer, earth layer, and sand layer, in which the ground is excavated by bits and chips. Excavated earth is taken into the chamber defined by the conical surface at the front of the shield tunneling body, and consolidated by the conical rotor eccentrically rotated about the center axis of the shield body in cooperation with the conical surface. Consolidated earth is pushed relatively rearward with the propulsion of the shield tunneling machine, mixed with water or muddy water in a water chamber following the rear portion of a chamber defined by the conical surface, and then exhausted through a pipe arranged in the shield body to the outside of the starting shaft.

However, there are instances where the ground to be excavated is composed of a monosoil layer. There are many instances in which gravel of a variety of sizes are contained in the soil layers. In the above-mentioned machine, large size gravel is introduced between the conical surface of the shield body and the conical rotor eccentrically rotated about the center axis of the shield body, and gravel is crushed by forces acting on the gravel which are imposed by the conical rotor eccentrically being rotated about the center axis of the shield body.

In crushing gravel, it is preferable that the conical rotor rotate at high revolutions. For this reason, the above-mentioned shield tunneling machine is constructed in such a manner that a crank shaft, for eccentrically rotating the conical rotor, and the conical rotor, be driven through an epicyclic mechanism so that the number of revolutions of the conical rotor is increased. In addition, the conical rotor is connected with an independent drive motor so the that number of eccentric revolutions of the conical cutter can be increased regardless of the number of revolutions of the cutter (spokes with bits and chips).

Using the above-mentioned shield tunneling machine, the ground can be excavated by crushing gravel and discharging crushed gravel with muck through a discharge pipe to a rear area of the machine. However, in the above-mentioned shield propelling machine, the cutter includes bits or chips, it is necessary that the number of revolutions of the cutter be controlled to lower velocity, in order to effectively excavate the ground. To control the cutter velocity at a lower velocity impairs the efficiency of crushing gravel by the conical rotors in cooperation with the conical surface of the shield body. Accordingly, in order to secure the proper number of revolutions of the conical rotor, it is necessary to mount a planetary gear mechanism or an independent drive on the shield tunneling machine. As such, the structure of the machine is complicated.

BRIEF SUMMARY OF THE INVENTION

It is an object of the present invention to provide a shield tunneling machine adaptable for excavating the ground for all types of soil, such as a rock mass layer, a boulder layer, and a cohesive soil layer, and which efficiently excavates a cohesive soil layer which would otherwise be difficult to accomplish with conventional shield tunneling machines.

The above-mentioned object can be attained, according to the present invention, by a shield tunneling machine comprises: a shield body having therein a soil chamber and an inside chamber following the soil chamber, said soil chamber having a conical peripheral surface gradually converging rearward; a partition wall provided in the rear of the soil chamber in the shield body which crosses the shield body and which divides the interior of the shield body into the soil chamber and the inside chamber; a crankshaft having an eccentric portion eccentrically located to the axis of the crankshaft, said crankshaft being rotatably supported through a bearing on the partition wall and having a rear end connected to a drive mechanism and extending forward to the front of the shield body; a conical rotor being rotatably mounted on the eccentric portion of the crankshaft, wherein said conical rotor is disposed in the soil chamber; a cutter disc on which roller bits are mounted being securely attached to the front end of the crankshaft; a wide opening formed in the cutter disc for taking crushed gravel into the soil chamber; and a means for discharging debris from the soil chamber to a rear area of the machine.

According to the present invention, the ground comprising a rock mass layer can be excavated by the roller bits mounted on the cutter disc. Further, in excavating the ground comprising a gravel layer, gravel taken into the soil chamber can be crushed into smaller sizes by the conical rotor rotatably mounted on the eccentric portion of the crankshaft so as to rotate about the axis of the shield body, crushed gravel is mixed with muddy water supplied into the muddy water chamber, and the mixture of crushed gravel with muddy water is discharged by the discharge means to the rear of the shield tunneling machine.

The number of revolutions of the cutter disc provided with roller bits is preferably about five to ten times as many as the number of revolutions of the cutter provided with chips. Further, according to the present invention, the efficiency of crushing gravel can be improved, because gravel taken into the soil chamber is efficiently crushed between the conical surface of the shield body and the conical rotor which is eccentrically moved about the axis of the shield body at an increased number of revolutions of the conical rotor in comparison to conventional crushers.

Since the shield tunneling machine, according to the present invention, comprises a crankshaft having an eccentric portion supported by the partition wall, the cutter disc on which the roller bits are securely mounted to the front end of the crankshaft and the conical rotor which is rotatably mounted on the eccentric portion of the crankshaft, it becomes possible to eccentrically rotate the conical rotor mounted about the axis of the shield body at the same number of revolutions as the number of revolutions of the cutter disc. Namely, when the number of revolutions of the cutter disc is increased to a higher number of revolutions than the number of revolutions of the conventional cutter disc on which bits or chips are mounted in order to efficiently operate most roller bits, the number of revolutions of the conical rotor can be increased together with the revolutions of the cutter disc. Further, no eccentric load acts on the roller bits because the cutter disc on which the roller bits are mounted are rotated about the axis of the shield body whereas the conical rotor is eccentrically rotated about the axis of the shield body. Accordingly, excavation of rock mass can be efficiently made.

DETAILED DESCRIPTION

Figure 1:
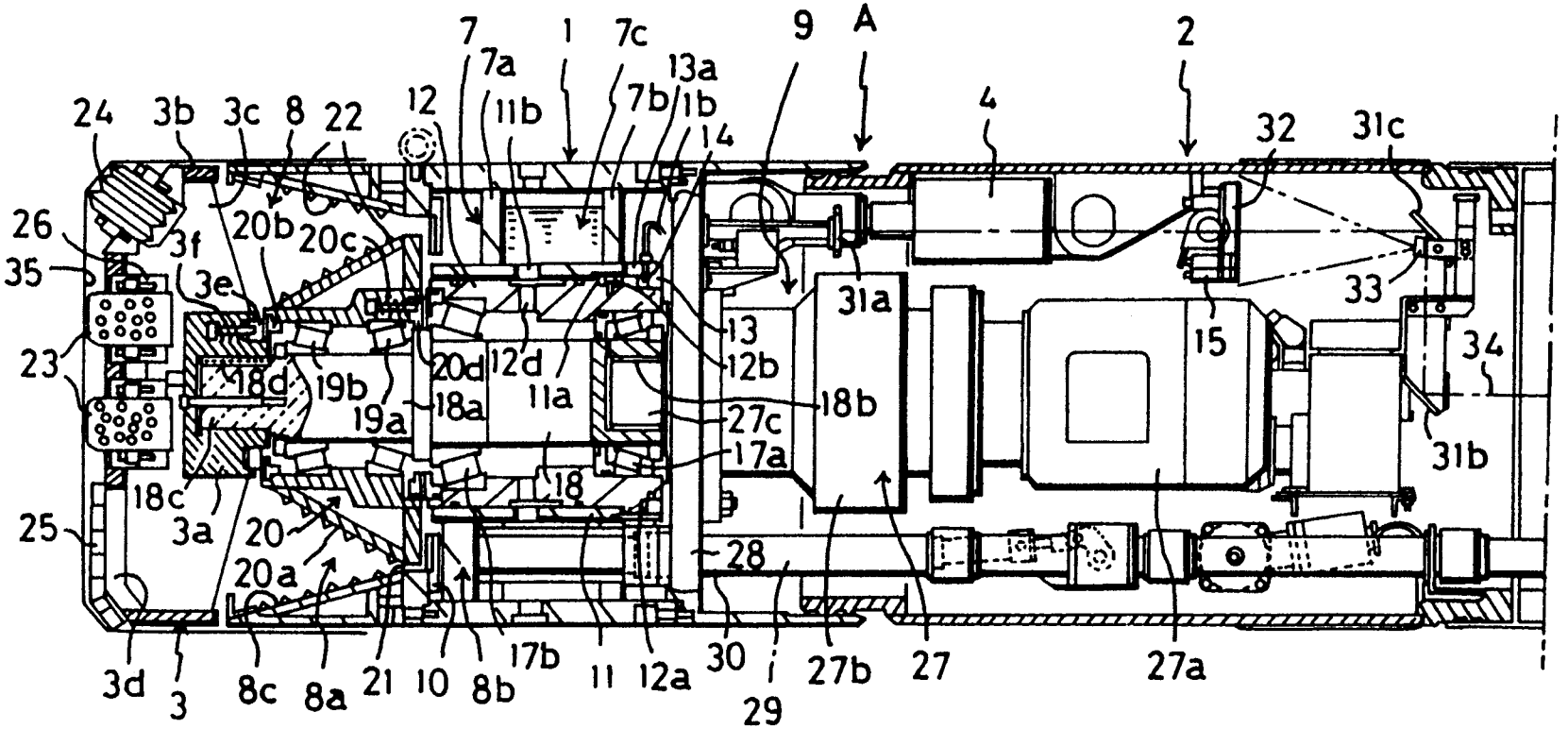
FIG. 1 is a sectional view of a shield tunneling machine according to the present invention.
Figure 2:
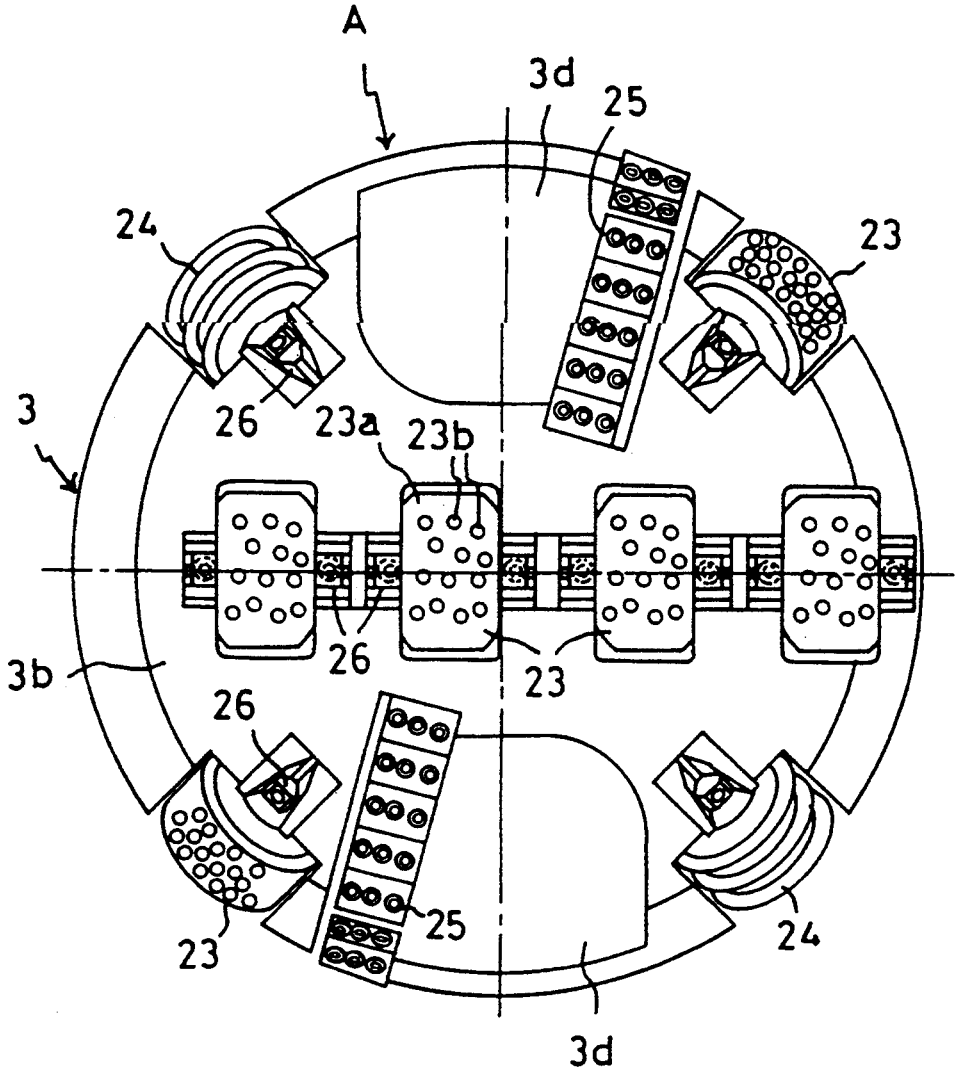
FIG. 2 is a front elevation of the shield tunneling machine.
Figure 3:
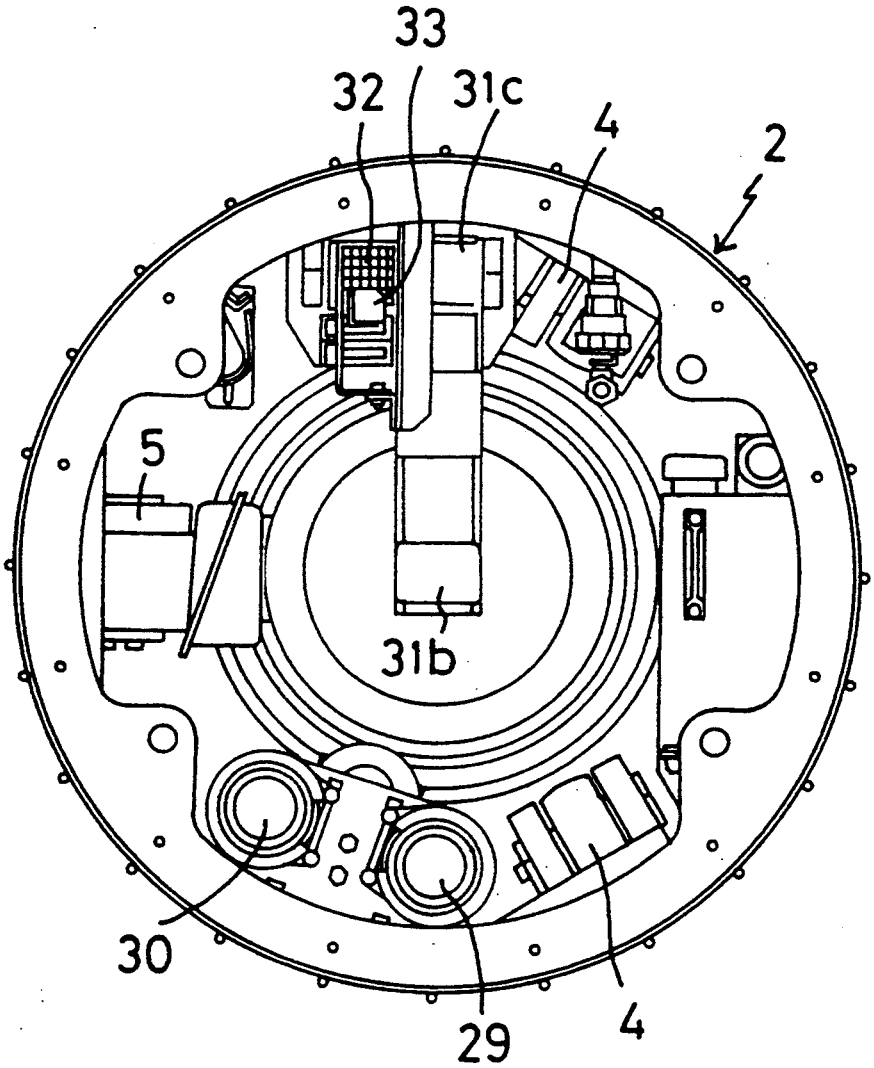
FIG. 3 is a rear elevation of the shield tunneling machine.

A shield tunneling machine A, according to the present invention, illustrated in FIGS. 1 through 3, is used in the semi-shield tunneling method used for lining conduits, such as sewers. The ground is excavated by a cutter disc mounted at the front of the shield tunneling machine A being driven, while the shield tunneling machine is propelled by a pipe propelling device (not shown in FIGS. 1 through 3) disposed at a starting shaft(not shown in FIGS. 1 through 3). Excavated gravel is broken down and discharged to the outside of the starting shaft. Plural pipes, such as Hume pipes, are connected to the rear end of the shield tunneling machine A with the pipes being interconnected, while the shield tunneling machine is propelled forward into the ground so that the projected sewer tunnel can be laid.

Referring to FIGS. 1 through 3, shield tunneling machine A comprises a shield body 1 and a tail shield 2. A cutter disc 3 including roller bits 23 and roller cutters 24 are rotatably mounted on the front end of the shield body 1 about the axis of the shield tunneling machine. The shield body 1 and the tail shield 2 are interconnected by two jacks 4 including hydraulic cylinders and rods 5(shown in FIG. 3). The jacks 4 and the rods 5 are disposed at angular intervals of 120 degrees around the axis of the shield tunneling machine. Hydraulic oil is supplied to each jack 4, independently of each other, so that the angle between the axis of the shield body 1 and the axis of the tail shield 2 can be controlled to a desired value. Accordingly, when the ground is excavated by the shield tunneling machine, the angle between the axis of the shield body 1 and the axis of the tail shield 2 can be altered so that the direction of the shield tunneling machine A can be controlled toward the projected line.

The shield body 1 is provided with a partition wall 7 extending across the interior of the shield body 1, in which the the space of the shield body 1 is divided into a front portion of the shield body 1, that is, a soil chamber 8 and a rear portion of the shield body 1, which is an inside chamber 9. An annular grating 10, which divides the interior of the soil chamber 8 into a crushing chamber **8*a* and a muddy water chamber 8*b* disposed between the grating 10 and the partition wall 7 is mounted ahead of the partition wall 7. The inside chamber 9 is constructed as a machine room which houses a reduction gear 27, gauges including an oil pressure gauge 15, mirrors 31*a*, 31*b*, 31*c* which refract the laser beams 34** for checking the direction of the propelled shield tunneling machine, and others.

An inner surface of the shield body 1, corresponding to an inner surface of the crushing chamber **8*a* (an inner surface 8*c* of the crushing chamber 8*a***) converges gradually from the front toward the rear to be formed into a surface of a cone, and in particular, that of a truncated cone.

The partition wall 7 is made of two plates **7*a*, 7*b*. Plates 7*a*, 7*b* are disposed with a desired distance between each plate 7*a*, 7*b*, which are welded to the inside wall of the shield body 1 so that the water tightness between the soil chamber 8 and the inside chamber 9 can be maintained. The space 7*c*, defined by plates 7*a* and 7*b*, are constructed as an oil chamber of lubricating oil for lubricating bearings 17*a*, 17*b*, 19*a*, 19*b* which rotatably bears a crankshaft 18**.

A tubular casing member 11 is secured to the center of the partition wall 7, coinciding the axis of the tubular casing member 12 with the axis of the shield body 1. A key way **11*a* is formed extending over the given length from the rear end surface of the casing member 11. Plural flowing through holes 11*a* for flowing lubricating oil are formed at the position corresponding to the room 7*c***.

The casing member 11 houses a sleeve 12. The sleeve 12 has a length thereof longer than the length of the casing member 11. A flange **12*a* is formed at the position corresponding to the length of the casing member 11. A key 12*b*, which has a length thereof shorter than the length of the key way 11*a*, is secured at a position corresponding to the key way 11*a* formed on the casing member 11. Accordingly, the sleeve 12 is mounted in the casing member 11 so as to be slidable in the axial direction and fixed against the casing member 11. When the sleeve 12 slides ahead, the movement of sleeve 12 is restricted by the flange 12***a* brought into contact with the rear-end surface of the casing member 11.

A slip link 12*c* is secured on the front end surface of the sleeve 12, and flows plurally through holes 12*d* for the lubricating oil which is formed at a position corresponding to the flow through holes 11*b* formed on the casing member 11.

A flange member 13 having a drum portion 13*a*, the length of which is longer than the length of the flange 12*a* of the sleeve 12, is attached to the rear end surface of the casing member 11. Accordingly, an oil pressure chamber 14 is formed between the interior of the flange member 13 and the flange 12*a* of the sleeve 12. An end of a connection member 16, such as a hose, for connecting the oil pressure chamber 14 and the oil pressure gauge 15 is provided in the tail shield 2 which acts as a hydraulic pressure gauge is secured to the tail shield 2 at the position corresponding to the oil pressure chamber 14 of the flange member 13. The oil pressure chamber 14 and the connection member 16 are filled with hydraulic oil as hydraulic fluid. When a force by which the sleeve 12 is moved ahead is applied on the rear side of the sleeve 12, the oil pressure gauge 15 reads the force through hydraulic oil which is contained in the oil pressure chamber 14 and the connecting member 16.

Plural bearings 17*a*, 17*b* for bearing the radial load and thrust load are provided on the sleeve 12. The crankshaft 18 is rotatably mounted in the sleeve 12 through bearings 17*a*, 17*b*. The crankshaft 18 includes an eccentric portion 18*a* with a given eccentricity which is formed on the crankshaft 18 at a position corresponding to the crankshaft 18. An engaging portion 18*b*, which is to be engaged with a spline shaft 27*c* of a drive 27, is formed on the rear end portion of the crankshaft 18 and an attached portion 18*c*, which is engaged with a boss portion 3*a* of the cutter disc 3 formed on the front end portion of the crankshaft 8.

A conical rotor 20 is mounted on the eccentric portion 18*a* of the crankshaft 18 through plural bearings 19*a*, 19*b* for bearing the radial load and thrust load. Accordingly, the conical rotor 20 is constructed so as to be rotatable about the eccentric portion 18*a* of the crank shaft 18 (rotation) and eccentrically revolvable about the axis of the shield body l(revolution).

An outward surface 20*a* of the conical rotor 20 tapers from the rear side toward the front side to be formed into a shape of a cone, and in particular, that of a truncated cone. The diameter of the rear end portion of conical rotor 20 is smaller than the diameter of the rear end portion of the crushing chamber 8*a*. A slit 21 for introducing excavated soil or debris through the grating 10 into the muddy water chamber 8*b* is formed between the rear end surface of the conical rotor 20 and the rear end portion of the crushing chamber 8*a*.

A slip ring 20*b* is secured on the front end surface of the conical rotor 20 and a slip ring 20*d*, which is spring-loaded rearwardly by a spring 20*c*, which is mounted on the rear end portion of the conical rotor 20. The slip ring 20*d* is brought into contact with the slip ring 12*c* secured on the front end portion of the sleeve 12 to act as an oil seal. Inner diameters of the slip rings 20*d*, and 12*c* are larger than the outer diameters of the crankshaft 18. Accordingly, a space between the sleeve 12 and the crankshaft 18, as well as a space between the crankshaft 18 and the conical rotor 20 are interconnected so that these spaces form an oil chamber for lubricating bearings 17*a*, 17*b*, 19*a*, 19*b* by a oil bath lubrication method.

As herein-above-mentioned, the inner surface 8*c* of the crushing chamber 8*a* converges gradually from the front, toward the rear forming a cone. Accordingly, the crushing chamber has an annular space with funnel form cross-sections tapering from the front toward the rear as shown in FIG. 1. The inner surface 8*c* of the crushing chamber 8*a* and the outer surface 20*a* of the conical rotor 20 have a number of projections 22. The projections 22 contribute to crushing gravel introduced into the crushing chamber 8*a* in such a size that the crushed gravel can pass through the slit 21.

When the crankshaft 18 is rotated, the conical rotor 20 is eccentrically moved about the axis of the crankshaft 18. That is, about the axis of the shield body 1. Since the conical rotor 20 is eccentrically moved, intervals between the outer surface 20*a* of the conical rotor 20 and the inner surface of the shield body 1, corresponding to the crushing chamber 8*a*, which changes according to the eccentricity of the conical rotor 20. Accordingly, gravel moved into the crushing chamber 8*a* as the shield tunneling machine A goes ahead can be crushed by receiving shocks from the conical rotor 20 and the projections 22. As the conical rotor 20 and projections 22 give a shock against the gravel, the conical rotor 20 is rotated about the eccentric portion 18*a* of the crankshaft 18. Crushed gravel is moved rearward through the hereinafter mentioned openings formed in the cutter disc rotary circular plate 3 in the soil chamber 8*b*, with the propulsion of the shield tunneling machine A.

The attached portion 18*c* of the crankshaft 18 is attached to a boss 3*a* of the cutter disc 3 through a key 18*d*. The cutter disc 3 is composed of a boss 3*a*, a cutter disc rotary circular plate 3*b* having a diameter about equal to the outer diameter of the shield body 1, and an arm 3*c* for connecting the boss 3*a* with the cutter disc rotary circular plate 3*b*, as shown in FIGS. 1 and 2. Plural openings 3*d* are formed in the cutter disc rotary circular plate 3*b* for taking excavated soil into the soil chamber. A width of the opening 3*d* can be maximized to one-third of the diameter of the cutter disc rotary plate 3*b*.

The boss 3*a* is provided with a slip ring 3*e* which is brought into contact with slip ring 20*b* secured on the front end portion of the conical rotor 20. The slip ring 3*e* is spring-loaded rearward by a spring 3*f* so that the slip ring 3*e* is pressed against the slip ring 20*b* in which slip ring 3*e* functions as a seal of the oil chamber formed within the conical rotor 20.

The roller bits 23, the roller cutters 24 and scrapers 25 are detachably attached on the outside of the cutter disc rotary circular plate 3*b*, respectively, wherein the roller bits 23 and the roller cutters 24 are rotatably attached to a bracket 26 fixed on the cutter disc rotary circular plate 3*b*, and the scrapers 25 are fixed on the surface of the cutter disc rotary circular plate 3*b*.

The roller bits 23 crushes or spalls mainly hard rock, and has bits 23 made of a super alloy, such as tungsten carbide, embedded in the roller 23*a*. The roller cutters 24 are used for crushing or spalling mainly rock with the medium hardness and formed of disc-shaped roller in which plural bits made of carbide are embedded or disc-shaped roller made of super alloy such as tungsten carbide.

As above-mentioned, the roller bits 23 and the roller cutter 24 are mounted on the cutter disc rotary circular plate 3*b*, so that the cutter disc 3 is formed by which the rock mass layer and the boulder layer can be securely excavated.

The reduction gear 27, driving the cutter disc 3 and the conical rotor 20, includes a motor 27*a* and a transmission gear 27*b* which is composed of a reduction gear mechanism and a change gear mechanism. The transmission mechanism 27*b* is provided with a spline shaft 27*c*, which is engaged with an engaging section 18*b* of the crankshaft 18 so that the driving force of the motor 27*c* can be transmitted through the crankshaft 18 to the cutter disc 3 and the conical rotor 20. The reduction gear 27 is fixed on a supporting wall 28 and arranged from the inside chamber 9 to the interior of the tail shield 2.

Crushed gravel and excavated soil introduced through the slit 21 from the crushing chamber 8*a* into the muddy water chamber 8*b* are exhausted through a discharge means from the shield tunneling machine A into the outside of the starting shaft. The discharge means, as shown in FIGS. 1 and 3, is composed of a liquid feed pipe 29 and a liquid discharge pipe 30. The liquid feed pipe 29 and the liquid discharge pipe open to the interior of the muddy water chamber 8*b*. The liquid feed pipe 29 is a pipe for supplying muddy water in which specific gravity is adjusted by the adjusting apparatus (not shown) to the muddy water chamber 8*b*. The liquid discharge pipe 30 is a pipe for discharging a mixed liquid of muddy water with debris in the muddy water chamber 8*b* to the outside of the starting shaft.

The mirror 31*a* is secured on the supporting wall 28 provided in the inside chamber 9 at the position being distant from the axis of the shield body 1. A pair of mirrors 31*b*, 31*c* which are arranged in the neighborhood of the rear end portion of the tail shield 2 with the reflecting surface thereof inclining at 45 degrees relative to the axis of the tail shield 2, respectively. An indicator 32 is provided between the mirrors 31*a* and 31*b*. A television camera 33 for taking photographs of the indicator 32 and gauges including the oil pressure gauge 15 arranged around the indicator 32 are arranged at the position opposing to the indicator 32.

In the above-mentioned construction, when a laser beam 34 is applied to mirrors 31*b*, 31*c* from the laser oscillator (not shown) arranged in the starting shaft coinciding with the direction of the laser beam with the axis of the tail shield 2, the laser beam 34 is refracted by the mirrors 31*b*, 31*c* to be directed to the indicator 32, as well as pass through the indicator 32, and is applied to the mirror 31*a*. Then, the laser beam 34 refracted from the mirror 31*a* is again directed to the indicator 32. An image mirrored in the indicator 32 is taken by the television camera 33 and shown in a monitor (not shown). Accordingly, it is possible to confirm whether the shield tunneling machine A being propelled on the laser beam 34, by surveying with the eye the position of the laser spot on the indicator 32 during the propulsion of the shield tunneling machine A. When the position of the laser spot on the indicator 32 changes the initiative place to another place thereon, hydraulic oil is supplied to the jacks 4 so that the direction of the shield body 1 against the tail shield 2 is regulated, by which the propulsion direction of the shield tunneling machine A can be controlled toward the projected line.

Hereinafter, operation of the shield tunneling machine A is explained. The propulsion of the shield tunneling machine is started from the starting shaft along the projected line. The propulsion is carried out by thrusting the rear end portion of the tail shield forward by means of a pipe propelling device (not shown) disposed in the starting shaft with the cutter disc 3 being driven. When the propulsion of the shield tunneling machine A into the ground has finished, the rear end of the shield tunneling machine A is connected with a first pipe, such as Hume pipe, and then the first pipe with the machine is thrust forward by the pipe propelling device. After the propulsion of the first pipe into the ground has finished, the rear end of the first pipe is connected with a second pipe, and then the second pipe in conjunction with the first pipe, thrusts the machine forward. Thereafter, these operations are continuously carried out by which the conduit is laid.

In the propulsion of the shield tunneling machine A, muddy water with given pressure is supplied to the muddy water chamber 8*b*. The muddy water acts on face 35 through the opening 3*d* of the cutter disc rotary circular plate 3*b*, which prevents the face 35 from being collapsed. The cutter disc 3 is driven by the reduction gear 27 to excavate the face 35. At this time, the face 35 is cut by the roller bits 23 and the roller cutters 24 mounted on the cutter disc rotary circular plate 3*b* in which the roller bits 23 and the roller cutters 24 differ in actions against the face. Namely, when a particular soil, forming the face 35, is the rock mass layer composed of hard rock, the rock mass layer is crushed largely by the roller bits 23. However, when the face 35 is the rock mass layer composed of soft rock, the rock mass layer is crushed mainly by the roller cutters 24.

Figure 4:
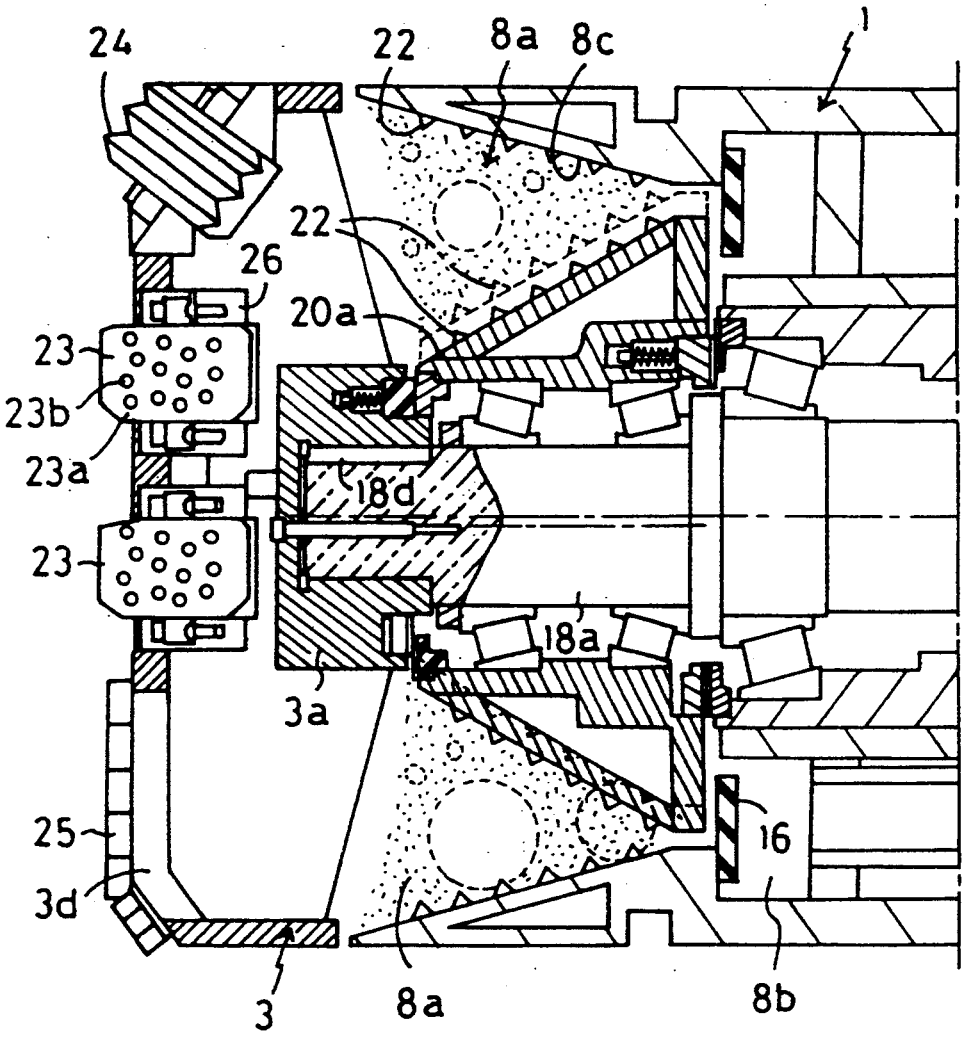
FIG. 4 is a sectional view showing the function of a conical rotor in the shield tunneling machine.

Excavated gravel is taken through openings 3*d* formed in the cutter disc rotary circular plate 3*b* into the crushing chamber 8*a*. As shown in FIG. 4, the gravel is moved rearward with the propulsion of the shield tunneling machine A. The movement of the gravel is stopped at the position where the distance between the outer surface 20*a* of the conical rotor and the inner surface 8*a* of the crushing chamber 8*a* is nearly equal to the outer diameter of the gravel. The projections 22 formed on the outer surface 20*a* of the conical rotor 20, which are eccentrically movable about the axis of the crankshaft 18, the axis of the shield body 1 gives a shock to the gravel so that the gravel can be broken down. The brake-down of the gravel is intermittently carried out until the gravel is broken down into such a scale that broken down gravel can be passed through the slit 21. When the conical rotor 20 gives shocks to the gravel, the conical rotor 20 turns about the eccentric portion 18*a* of the crankshaft 18 by receiving its reaction.

In the above mentioned process, the number of revolutions of the cutter disc 3 is maintained to be five to ten times as many the number of revolutions of a conventional cutter with bits or chips. Namely, the crankshaft 18 is rotated at a higher revolving speed than that of the conventional shield tunneling machine. Accordingly, the speed of the eccentric movement of the conical rotor 20 becomes higher so that the efficiency of crushing the gravel taken into the crushing chamber 8*a* can be improved. Further, cohesive soil taken into the crushing chamber 8*a* can rapidly be consolidated by the conical rotor 20 which is eccentrically moved about the axis of the crankshaft at a high speed. Accordingly, the discharge of consolidated cohesive soil into the muddy water 8*b* can be smoothly carried out so that the efficiency of crushing gravel can be improved. It then becomes possible to improve the efficiency of crushing gravel and of discharging cohesive soil into the muddy chamber by the conical rotor 20 which is being eccentrically moved about the axis of the shield tunneling machine at a high revolution speed, and which normally has been difficult to achieve by conventional shield tunneling machines.

In the propulsion process, thrust is given to the shield tunneling machine A by the pipe propelling device disposed in the starting shaft. A thrust is transmitted through the tail shield 2, and the shield body 1 to the roller bits 23, and the roller cutters 24 which cuts the face 35. For example, when the face 35 is composed of a layer of substance which has a higher cutting resistance, great forces act on the roller bits 23 and the roller cutters 24. According to circumstances, the roller bits 23 and the roller cutters 24 are broken by these forces acting thereon. Further, the excavation of the face 35 or the propulsion of the shield tunneling machine A is hindered.

In the present embodiment, the shield tunneling machine is designed to excavate all types of ground, encompassing a rock mass layer to boulders, sand and gravel, cohesive soil, and soft ground. Accordingly, in the shield tunneling machine according to the present invention, when the face 35 is excavated, forces acting on the roller bits 23 or the roller cutters 24 are transmitted to the cutter disc rotary circular plate 3*b*, and the crankshaft 18 to the sleeve 12, and the forces are exerted on hydraulic oil which is contained in the oil pressure chamber 14. Forces exerted on the hydraulic oil are shown on the oil pressure gauge 15. In addition, forces acting on the roller bits 23 or the roller cutters 24 are shown on the oil pressure gauge 15. Further, since ground pressure acting on the conical rotor 20 is exerted through the openings of the cutter disc 3 into the interior of the soil chamber, ground pressure at the face of the soil chamber can be indirectly measured. Accordingly, the oil pressure chamber 15 is provided with graduations in both the pressure indicator and the ground pressure indicator. An operator can observe the oil pressure gauge 15 through a monitor. When the indication is increased over the given value, the propulsion speed of the shield tunneling machine A can be decreased, or the number of revolutions of the cutter disc 3 can be increased, in which forces exerted on the roller bits 23 and the roller cutters 24 can be controlled.

As described above, the shield tunneling machine according to the present invention, comprises a cutter disc with roller bits mounted at the front of the shield tunneling machine, the cutter disc being rotated about the axis of the shield tunneling machine, and a conical rotor rotatably mounted on the eccentric portion of the crankshaft behind the cutter disc, in which the ground to be excavated is composed of a rock mass layer. Excavation of the ground can be accomplished by rotating the cutter disc at a higher revolution velocity to such an extent that the ground can be efficiently excavated, and gravel taken into the soil chamber can be efficiently broken down by the conical rotor eccentrically moved about the axis of the shield body. Further, cohesive soil can be easily discharged into the muddy water chamber, and crushed gravel and soil mixed with muddy water can be discharged to the outside of the starting shaft.

Further, in the shield tunneling machine, forces exerted on the roller bits can be shown on the oil pressure gauge. Accordingly, forces exerted on the roller bits can be controlled so that effective excavation can be carried out. Furthermore, since ground pressure at the face of the shield tunneling machine can be indirectly measured, the control of ground pressure at the face, composed of soft ground, which may collide with a gravel layer is possible, and damages to roller bits can be prevented.

What is claimed is:

1. A shield tunneling machine comprising:

a shield body having therein a soil chamber and an inside chamber following the soil chamber, said soil chamber having a conical inner surface converging gradually rearward;

a partition wall provided in the rear of the soil chamber in the shield body for dividing the interior of the shield body into the soil chamber and the inside chamber;

a crankshaft having an eccentric portion which is eccentric to the axis of the crankshaft, and having a rear end connected to a drive mechanism and extending forward to a front of the shield body;

a conical rotor rotatably mounted on the eccentric portion of the crankshaft, said conical rotor disposed in the soil chamber;

a cutter disc including a cutter disc rotary plate on which roller bits are mounted, the cutter disc being fixedly secured to the front end of the crankshaft;

at least one opening formed in the cutter disc rotary plate for taking crushed gravel into the soil chamber, said opening have a width of one-third of the diameter of the rotary disc plate; and means for discharging debris from the soil chamber to a rear area of the machine.

2. A shield tunneling machine as claimed in claim 1, wherein the conical inner surface of the shield body and outer surface of the conical rotor are provided with a plurality of projections.

3. A shield tunneling machine as claimed in claim 1, wherein roller cutters are also mounted on the cutter disc rotary plate.

4. A shield tunneling machine as claimed in claim 1, wherein the crankshaft is supported by a bearing on the partition wall.

* * * * *